US006056058A

United States Patent [19]

Gonzalez

[11] Patent Number: 6,056,058

[45] Date of Patent: May 2, 2000

[54] METHODS AND APPARATUS FOR AUTOMATICALLY LAUNCHING STICKS OF VARIOUS MATERIALS INTO OIL AND GAS WELLS

[76] Inventor: Leonel Gonzalez, Box 3351, Zapata, Tex. 78076

[21] Appl. No.: 09/179,227

[22] Filed: Oct. 26, 1998

[51] Int. Cl.[7] ..... F21B 33/068; F21B 37/06

[52] U.S. Cl. ..... 166/310; 166/53; 166/75.15

[58] Field of Search ..... 166/53, 75.15, 166/309, 310, 311; 221/265

[56] References Cited

U.S. PATENT DOCUMENTS

| | | | |
|---|---|---|---|
| Re. 23,583 | 11/1952 | Eilerts . | |
| 2,713,909 | 7/1955 | Baker . | |
| 3,039,531 | 6/1962 | Scott . | |
| 4,235,849 | 11/1980 | Handleand . | |
| 4,785,880 | 11/1988 | Ashton | 166/53 |
| 4,830,112 | 5/1989 | Erickson | 166/304 |
| 5,188,178 | 2/1993 | Noyes | 166/310 |
| 5,515,924 | 5/1996 | Osterhoudt, III | 166/309 |
| 5,813,455 | 9/1998 | Pratt et al. | 166/310 |

OTHER PUBLICATIONS

Photographs of an automatic stick launcher currently in use by J & J Oilfield & Electric Service, Jim Votaw (undated).

*Primary Examiner*—George Suchfield
*Attorney, Agent, or Firm*—George S. Gray

[57] ABSTRACT

An apparatus, and related methods, for automatically releasing sticks of various materials into oil and gas wells. The apparatus has an enclosed magazine which has several chambers for the sticks. The magazine rotates on a shaft when a sprocket on the shaft is engaged by a rod moving from an extended to a retracted position. The rod movement is actuated by a double acting cylinder which is powered by well gas. When rotated the magazine positions the next chamber above a bottom exit port which is aligned with the well, causing the stick to be released into the well. During the stick loading process, only a single valve need be opened to enable the sticks to be loaded into the stick chambers. The magazine is rotated by hand after each stick is loaded.

48 Claims, 8 Drawing Sheets

METHODS AND APPARATUS FOR AUTOMATICALLY LAUNCHING STICKS OF VARIOUS MATERIALS INTO OIL AND GAS WELLS

BACKGROUND OF THE INVENTION

It is a common production practice to release various dissolvable materials into oil and gas wells. These materials are often stick shaped.

For example, an oil and gas well's production of hydrocarbons is often terminated by the presence of produced formation water in the well. This occurs when a column of such water has a hydrostatic pressure higher than the pressure of the producing formation. To prevent this from occurring, it is common to periodically release "soap" sticks into the well which, when dissolved, will decrease the hydrostatic pressure of the fluid column to an extent which allows the formation to continue to flow.

The actual release of such sticks is typically done by hand, although mechanical stick release devices are now in use. One such stick release mechanism is found in U.S. Pat. No. 5,188,178, which teaches a device and related methods, involving an enclosed magazine holding several sticks. It has the ability to rotate each stick into a position to be dropped into the well. A disadvantage present in this device is that the entire top of the magazine enclosure must be removed for loading the sticks into the magazine. Furthermore, the top of the device is flat which is not an optimum design for handling high pressure in an enclosure.

An electric motor is suggested for rotating the magazine in this device, which fails to take advantage of the available well gas pressure for this purpose.

Other disadvantages of this device is a lack of total isolation from well pressure during the typical reloading process, and the absence of an emergency shut down feature for events of unusually high well pressure. The device is isolated from well liquids only, using a check valve which is not pressure sensitive. The check valve also introduces a reduction of internal diameter in the path followed by the stick.

Another known device, that of J & J Oilfield & Electric Service, utilizes well gas pressure to automatically open a number of valves positioned in series between each pipe nipple section in a vertically oriented single line. The valves are opened from the bottom up, and pipe nipple holds two sticks of material, with the higher section dropping sticks through the previously emptied lower section. A disadvantage is that the number of releases is limited to approximately two, because of the undesirable height associated with additional sections. Similarly, the person reloading the device must climb a significant height to load the device.

What is needed is an automatic stick launcher for releasing such sticks, which has a simple method of loading, total isolation of the magazine from well pressure and liquids during reloading, optimum housing structural integrity, adequate provisions for higher pressure wells, an ability to operate almost entirely from available well pressure, and an emergency shut down system in the event the well over pressures.

SUMMARY OF THE INVENTION

My device is an automatic stick launcher for an oil and gas well, that provides a simple method for loading the sticks, optimized housing structural integrity, provisions for higher pressure wells, the ability to operate from available well pressure, and an emergency shut down system in the event the well over pressures.

My invention includes an apparatus for periodically inserting sticks of various materials into an oil or gas well, with a magazine being enclosed by a housing, where the magazine has two or more stick chambers which are shaped to receive the sticks and also orient the sticks in a substantially vertical position. The magazine is rotatable within the housing which, in some preferred embodiments, has a generally dome-shaped top and bottom. The housing top has a closable entry port, which is aligned with only one of the stick chambers and is sized to allow one of the sticks to move into the stick chamber through the housing top entry port. The housing also has a bottom exit port which is in communication and alignment with the well, such that a stick may pass from one of the stick chambers into the well through the housing bottom exit port. A shaft is attached to the magazine which rotates with the magazine, with the shaft extending through the top or bottom of the housing in various preferred embodiments. Periodic rotation means are provided for rotating the shaft such that the stick chambers are sequentially positioned in stationary alignment with the housing bottom exit port. Both automatic and manual periodic rotation means are provided in various preferred embodiments. In one preferred embodiment the periodic rotation means are initiated in response to timer means. My invention contemplates a battery for powering the timer and a solar panel for charging the battery.

My invention includes a preferred embodiment wherein the periodic rotation means is powered by an electric motor.

My invention contemplates a magazine having stick chambers shaped to receive more than one stick per stick chamber and to position the same in a stacked, substantially in line configuration.

In one preferred embodiment of my invention, the shaft is rotated by pneumatic ratchet means which automatically rotates the shaft such that the stick chambers are sequentially positioned in stationary alignment with the housing bottom exit port. The pneumatic ratchet means, in one preferred embodiment, includes a shaft rotation gear attached to the shaft, a double acting cylinder actuator in which alternating pressure in the cylinder causes a rod to move between an extended position and a retracted position with respect to the cylinder. A rod connecting arm is pivotally attached to the shaft and the rod's exposed end, and a ratchet pawl is attached to the rod connecting arm and is positioned to engage and rotate the shaft rotation gear upon return of the rod from its extended position to its retracted position. The rod is moved between positions by actuator pressure means which alternately pressurizes and depressurizes the cylinder causing the rod to move between its extended and retracted positions. My invention contemplates using either gas well pressure or an independent source of pressure to power the actuator pressure means.

In one preferred embodiment of my invention, well pressure reduction means is provided to reduce the pressure of the well gas prior to pressurization of the actuator.

In another preferred embodiment, released gas recovery means are provided to contain gas released by the actuator during depressurization.

In various preferred embodiments of my invention, the initiation of shaft rotation by various means is in response to low differential pressure in the well, low static pressure in the well, a predetermined decrease in well production rate, remote signals, automatic dialing codes enabling control by telephone from a remote location, and other variable processes.

My invention includes preferred embodiments wherein housing seal means such that well gas is contained within the housing during intervals between stick releases.

In another preferred embodiment of my invention, well isolation means are provided for isolating the housing top entry port from well gas pressure. In one preferred embodiment, this apparatus is a bottom valve between the housing bottom port and the well. Various preferred embodiments include pressure sensitive check valves, liquid sensitive check valves, and ball valves for use in this regard. A preferred embodiment of my invention includes pressure equalization means, such that pressure communication can be alternately established and broken between the well and the housing while the bottom valve is closed.

Emergency isolation means are provided in one preferred embodiment which automatically isolates the housing from well gas pressure when the well gas pressure exceeds a predetermined level.

Another preferred embodiment of my invention includes housing pressure relief means for venting pressure from within the housing when such pressure exceeds a predetermined level.

My invention includes a process for periodically inserting one or more sticks of various materials into an oil or gas well, including the steps of (1) providing an apparatus having a magazine with individual stick chambers, with one or more of the magazine stick chambers containing one or more sticks, the apparatus being attached to the well, (2) rotating the magazine until one of the sticks is released into the well, and (3) repeating the foregoing step, if desired, for one or more additional sticks until a predetermined number of sticks have been released into the well.

My invention includes an apparatus for periodically inserting one or more sticks of various materials into an oil or gas well having stick positioning means for receiving and holding the sticks and positioning the sticks in a substantially vertical orientation, well entry means providing a path for the stick to exit the apparatus and enter the well, and periodic rotation means for moving each stick into position for insertion into the well.

My invention includes a process for loading sticks of various materials into an automatic stick launcher of the type having a magazine rotatably mounted within a housing, the magazine having a plurality of stick chambers for holding the sticks prior to periodic release into an oil and gas well, the process including the steps of providing the stick launcher with a permanently enclosed housing top having an entry port aligned with only one stick chamber, isolating the magazine from well pressure, if necessary, by opening the entry port, inserting one or more sticks into the aligned stick chamber, by rotating the stick chamber until one of the additional stick chambers becomes aligned with the entry port, by repeating, as necessary, until the desired number of stick chambers are loaded, closing the entry port, and reestablishing well pressure to the magazine, if necessary.

Another preferred embodiment of my invention includes an apparatus for loading sticks of various materials into an automatic stick launcher of the type having a magazine rotatably mounted within a housing, the magazine having plurality of stick chambers for holding the sticks prior to periodic release into an oil and gas well, having isolated stick chamber loading means such that access through the housing top is limited to only one stick chamber at a time.

My invention includes a preferred embodiment including an apparatus for loading sticks of various materials into an automatic stick launcher of the type having a magazine rotatably mounted within a housing, the magazine having a plurality of stick chambers for holding the sticks prior to periodic release into an oil and gas well, this preferred embodiment having a housing top, the housing top being permanently attached to the housing, the housing top having an entry port, the housing top entry port being positioned for sequential alignment with each of the stick chambers as the magazine is rotated, the housing top entry port being of sufficient width to allow the passage of one of the sticks, and housing top entry port access means for opening and closing the housing top entry port. In one preferred embodiment, the top port access means is a ball valve and a nipple, the nipple connecting to the housing top entry port and the ball valve.

DESCRIPTION

Figure 1:
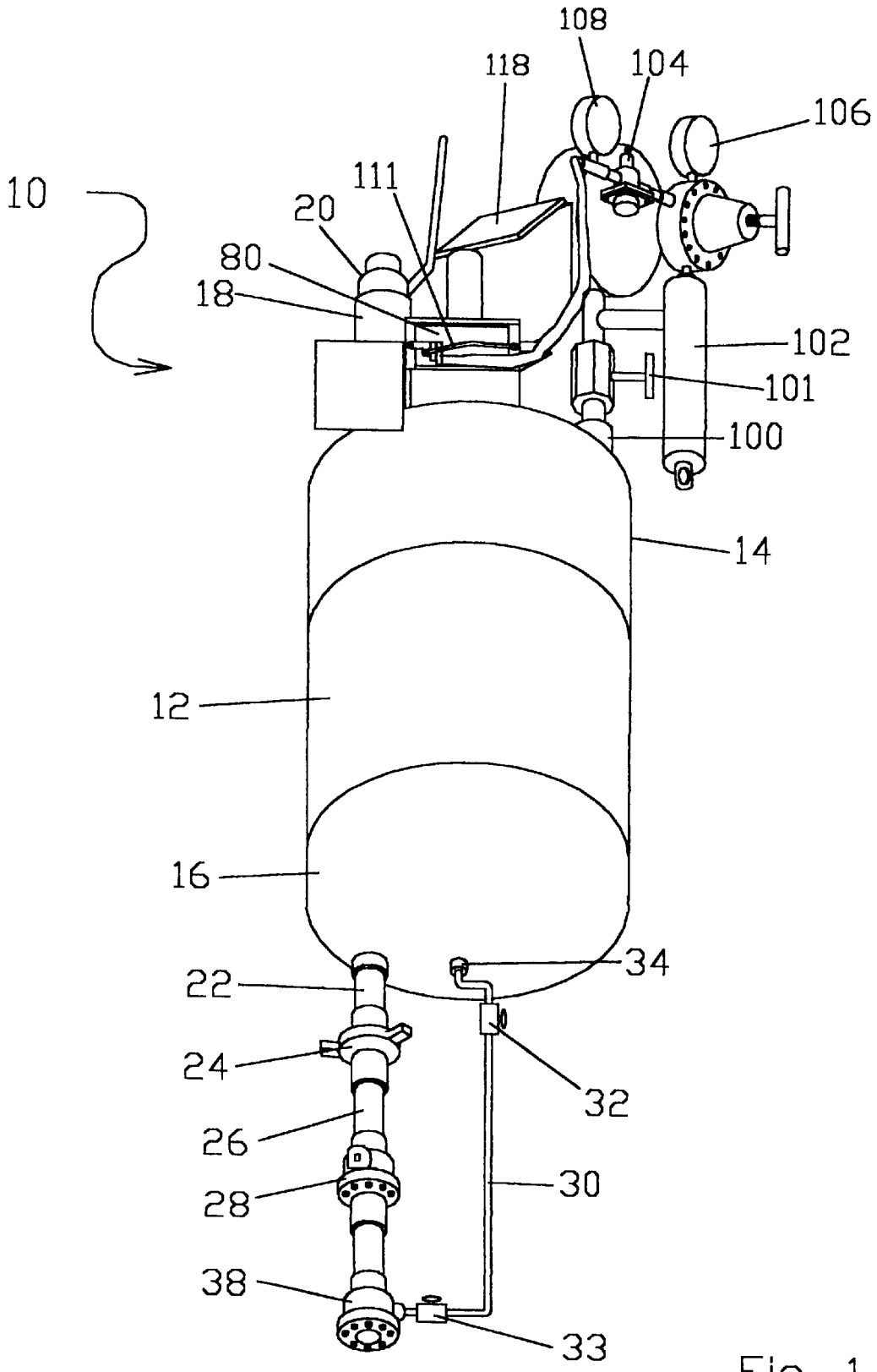
FIG. 1 is an oblique view of the device installed on an oil and gas well.
Figure 2:
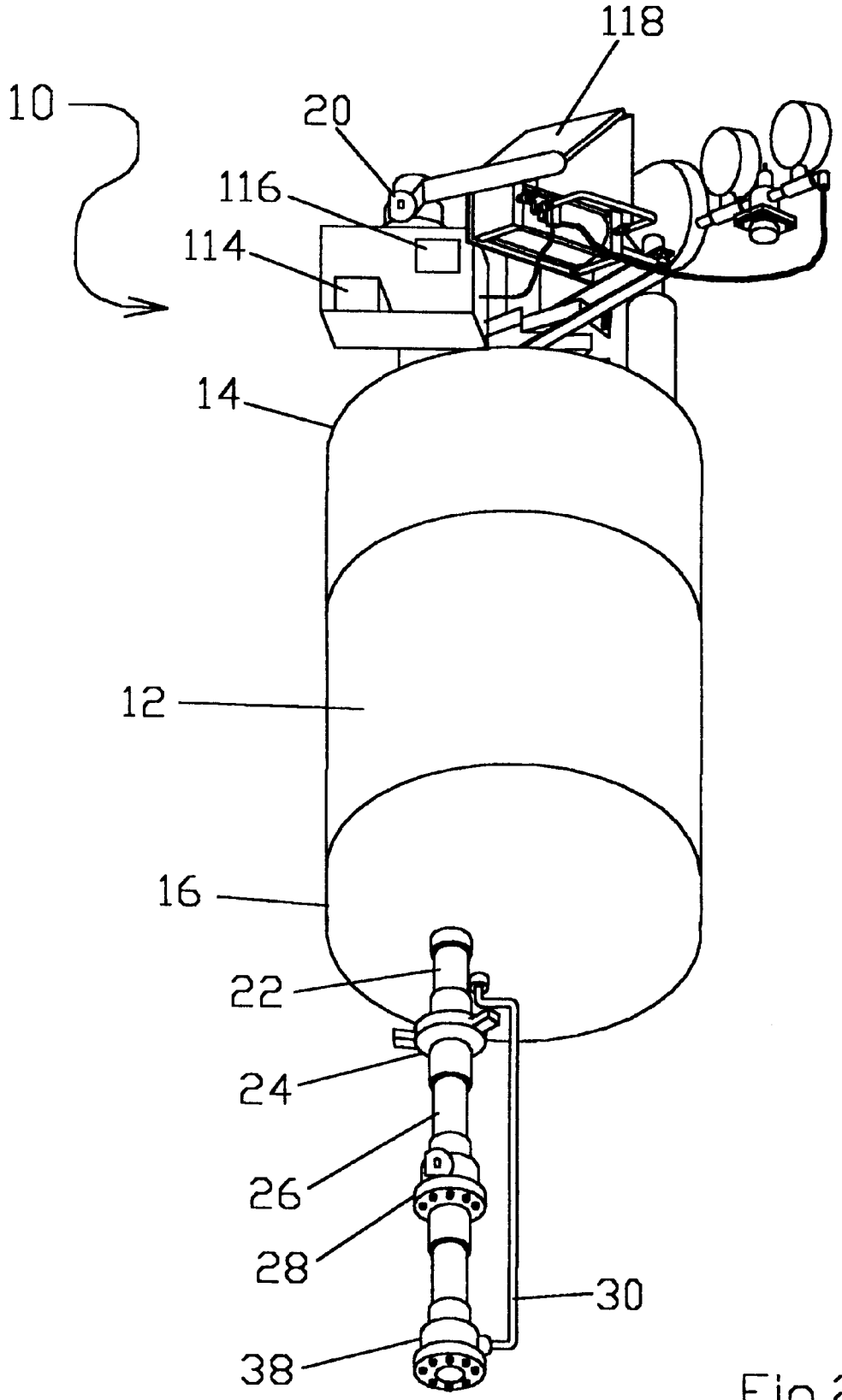
FIG. 2 is an oblique view of the device installed on an oil and gas well from a second angle.

A preferred embodiment of the device 10 is shown in position on a typical gas well in FIGS. 1–2. The housing 12 has a generally domed shaped housing top 14 and a generally domed shaped housing bottom 16. The housing top 14 is accessible through a housing top port nipple 18 which, in this preferred embodiment, is a 2 inch I.D. nipple made from Schedule 80 steel. A top ball valve 20 is attached to the housing top port nipple 18 for alternately opening or closing the housing top port nipple 18. A full port 2 inch I.D. ball valve is utilized for the top ball valve 20, in this preferred embodiment. Sticks are loaded through the top ball valve 20, through the housing top port 18, and into the housing 12.

The housing bottom 16 is accessible through a housing bottom port swage 22, which, in this preferred embodiment, is a 2½ inch I.D. to 2 inch I.D. swage made of Schedule 80 steel. For servicing convenience a hammer union 24 is attached to the housing bottom port swage 22. A 2 inch I.D. nipple 26, made from Schedule 80 steel, extends downwardly from the hammer union 24 to a bottom ball valve 28 for alternately opening and closing the housing bottom port nipple 22 for passage of a stick. A full port 2 inch I.D. ball valve is utilized for the bottom ball valve 28 in this preferred embodiment, although pressure sensitive or liquid sensitive check valves can be used in other preferred embodiments. Both the top ball valve 20 and the bottom valve 28 are rated at 2000 psi in this preferred embodiment.

An equalizer line 30 is provided in this preferred embodiment, with a first equalizer valve 32 and a second equalizer valve 33, positioned on the equalizer line 30. The equalizer line 30 is attached to an equalizer port 34 on the housing bottom 16, establishing fluid communication between the housing 12 and the well 36 at a well swage 38 which is attached to the bottom ball valve 28. In this preferred embodiment, the equalizer line 30 is ⅜ inch stainless steel tubing rated at 3000 psi, and the equalizer valves 32,33 are needle valves rated at 6000 psi.

Figure 3:
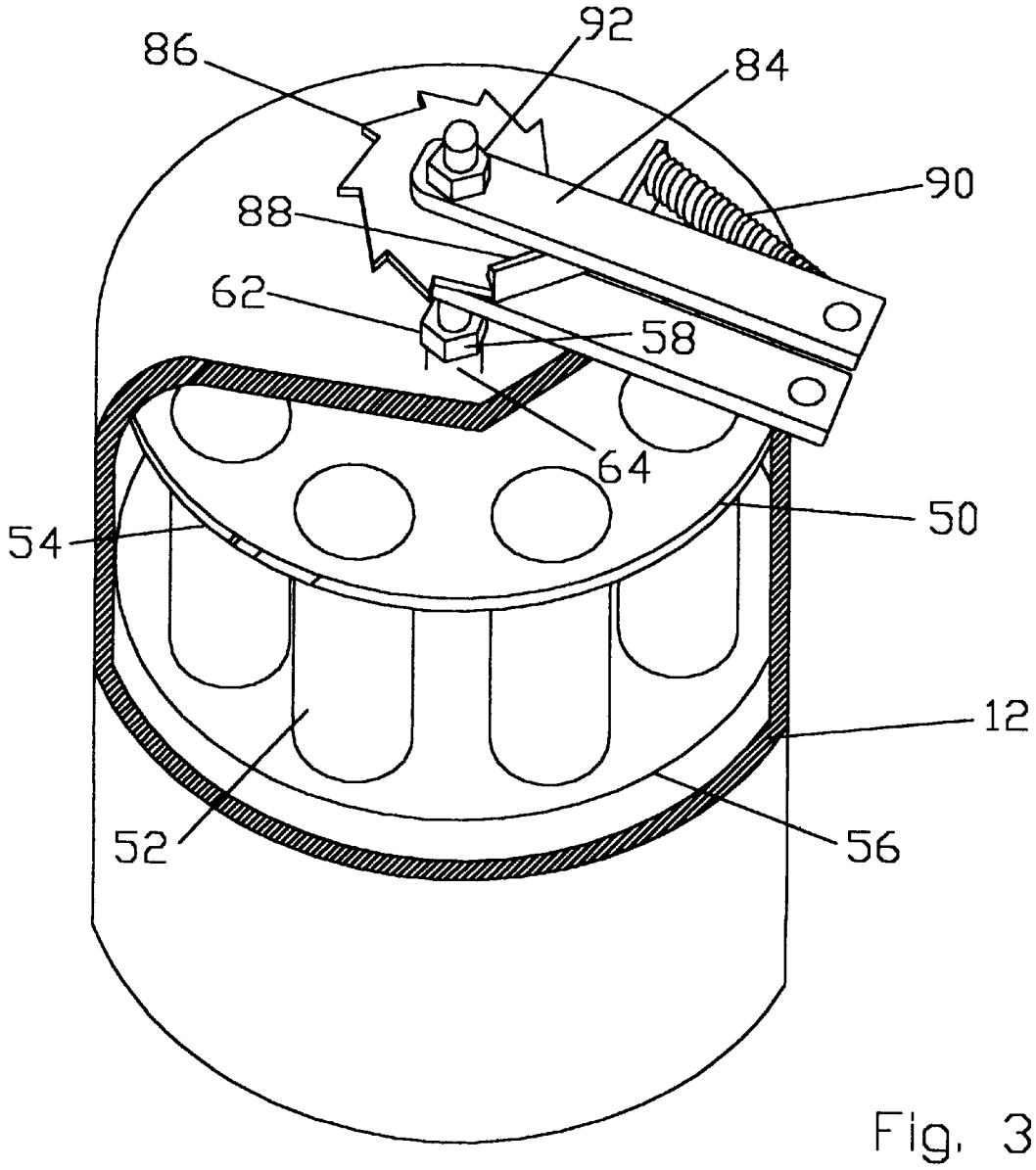
FIG. 3 is a cutaway exposing the top portion of the magazine.
Figure 4:
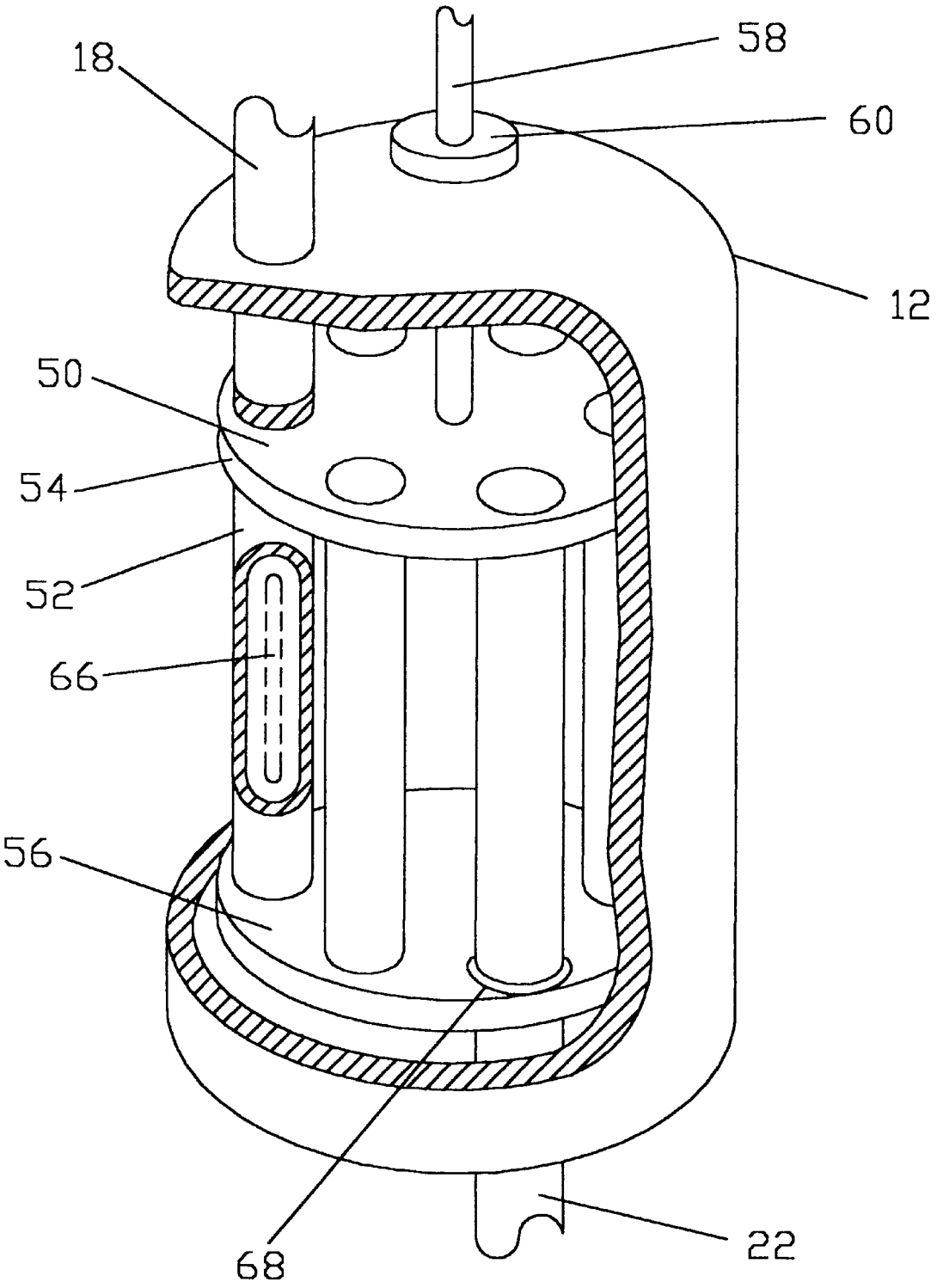
FIG. 4 is a cutaway exposing a side view of the magazine, and a stick positioned within a stick chamber.
Figure 5:
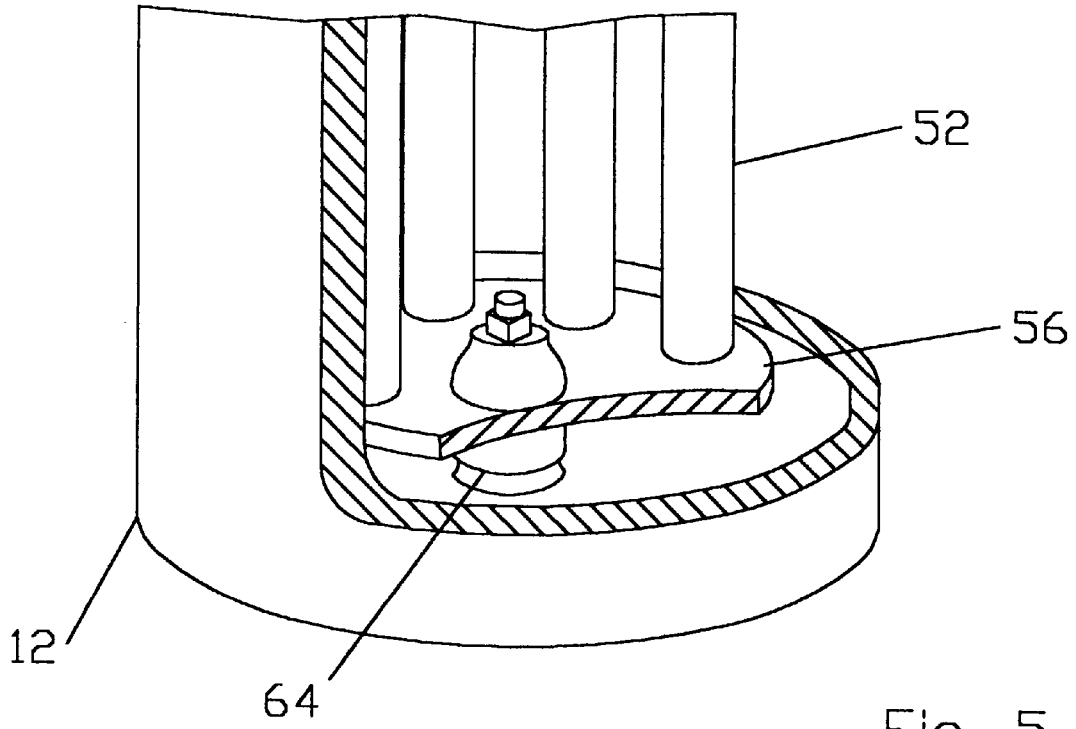
FIG. 5 is a cutaway exposing the lower portion of the magazine.

FIGS. 3–5 depict the housing 12 portion of the device 10, with various portions of the housing 12 removed to allow a view of the magazine 50, the magazine 50 being formed from the joinder of the 11 stick chamber sections 52 to a magazine top plate 54 and a magazine bottom plate 56, with a shaft 58 attached to the magazine 50 and extending upwardly through a housing top shaft port 60, the housing top shaft port being sealed by a shaft packing assembly 62. The magazine 50 is supported by a spindle and bearing assembly 64 for rotation within the housing 12. In this preferred embodiment the housing 12 is constructed from Schedule 80 steel. The magazine top and bottom plates 54,56 are constructed from 3/16 inch mild steel plate. The stick chamber sections 52 are 1¾ inch I.D., gauge 10 stainless steel. The shaft 58 is formed from a cold roll steel axle spindle rated at 2000 pounds. The shaft packing assembly 62 is a pinion gear head assembly, and the spindle and bearing assembly 64 is rated for 2000 pounds. These materials, although chosen for this preferred embodiment, could be replaced by numerous other combinations of various grades of steel, aluminum, fiberglass and other materials well known to persons skilled in the art.

A representative stick 66 is shown in a partial cutaway view of a stick chamber 52 in FIG. 4. The housing bottom port 68 is also depicted in relation to the housing bottom port nipple 22.

Figure 6:
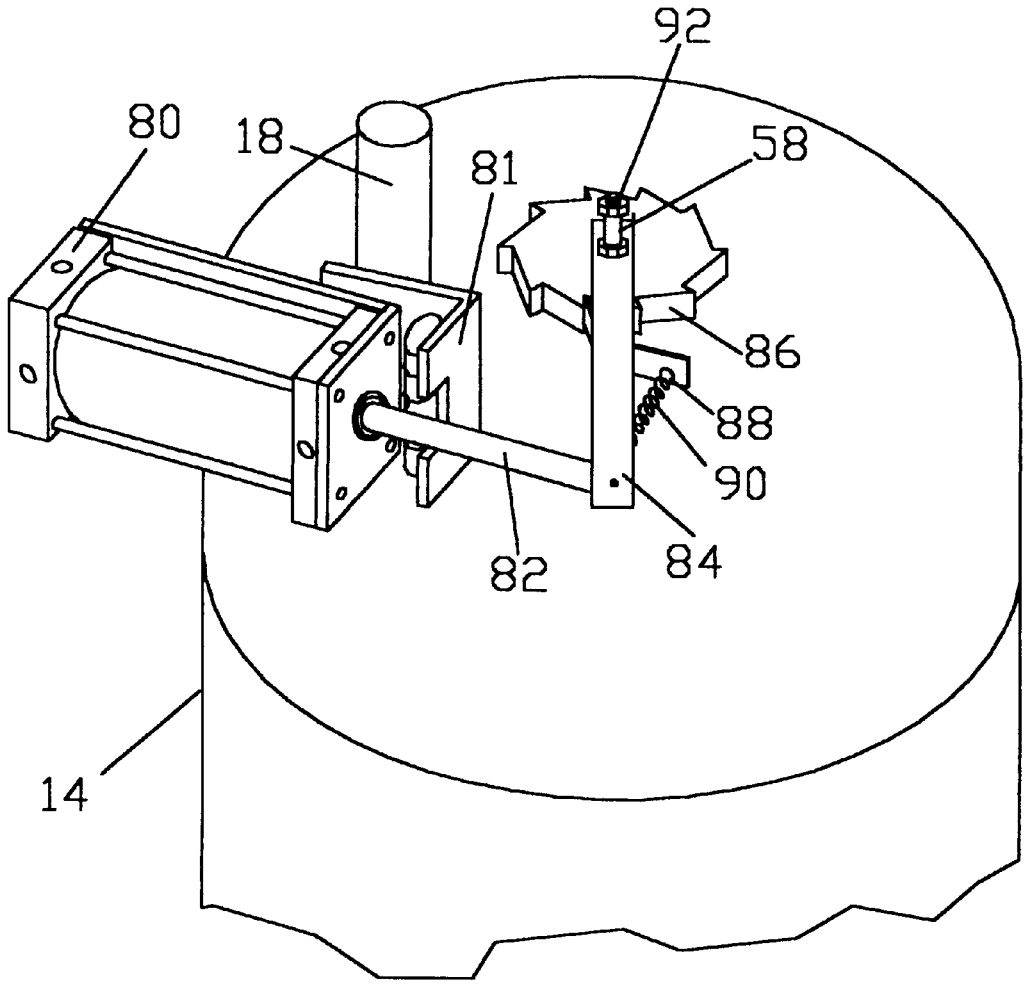
FIG. 6 is an oblique view of a portion of the ratchet mechanism with the rod extended.
Figure 7:
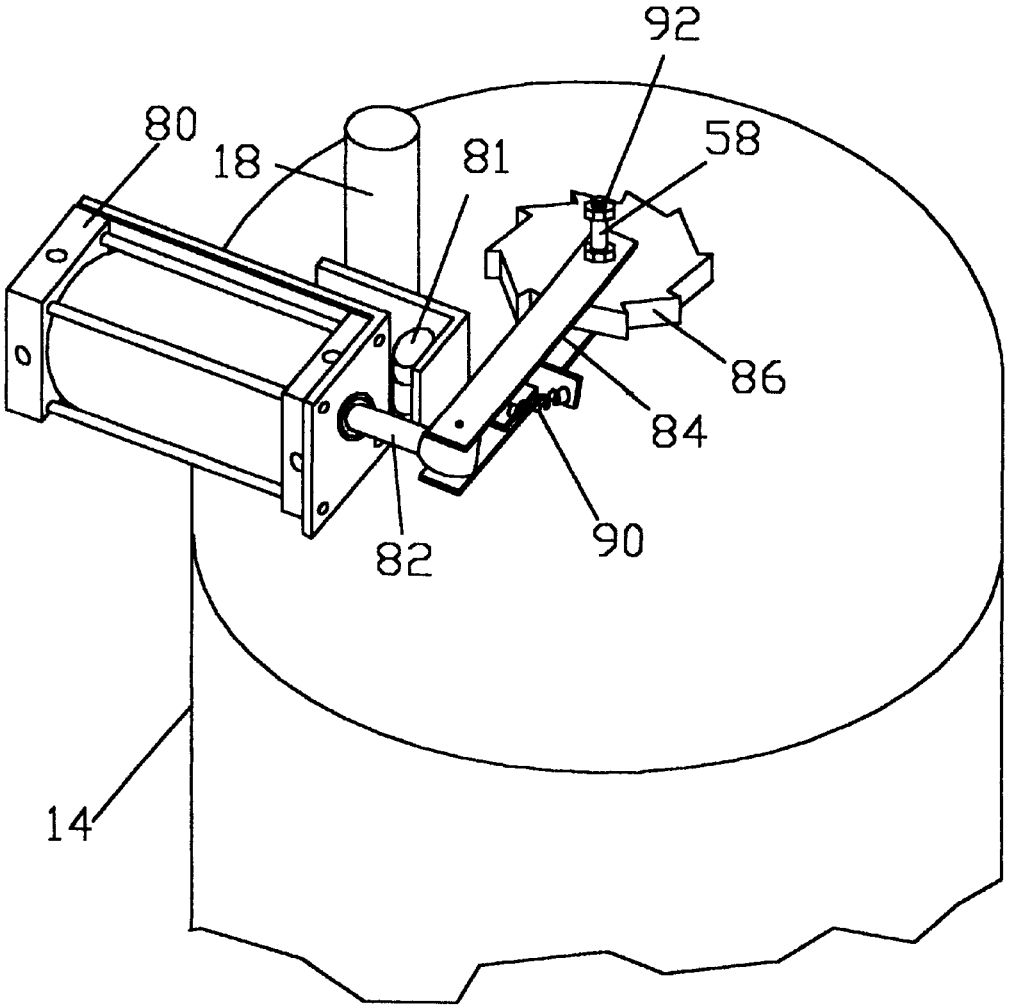
FIG. 7 is an oblique view of a portion of the ratchet mechanism with the rod retracted.
Figure 8:
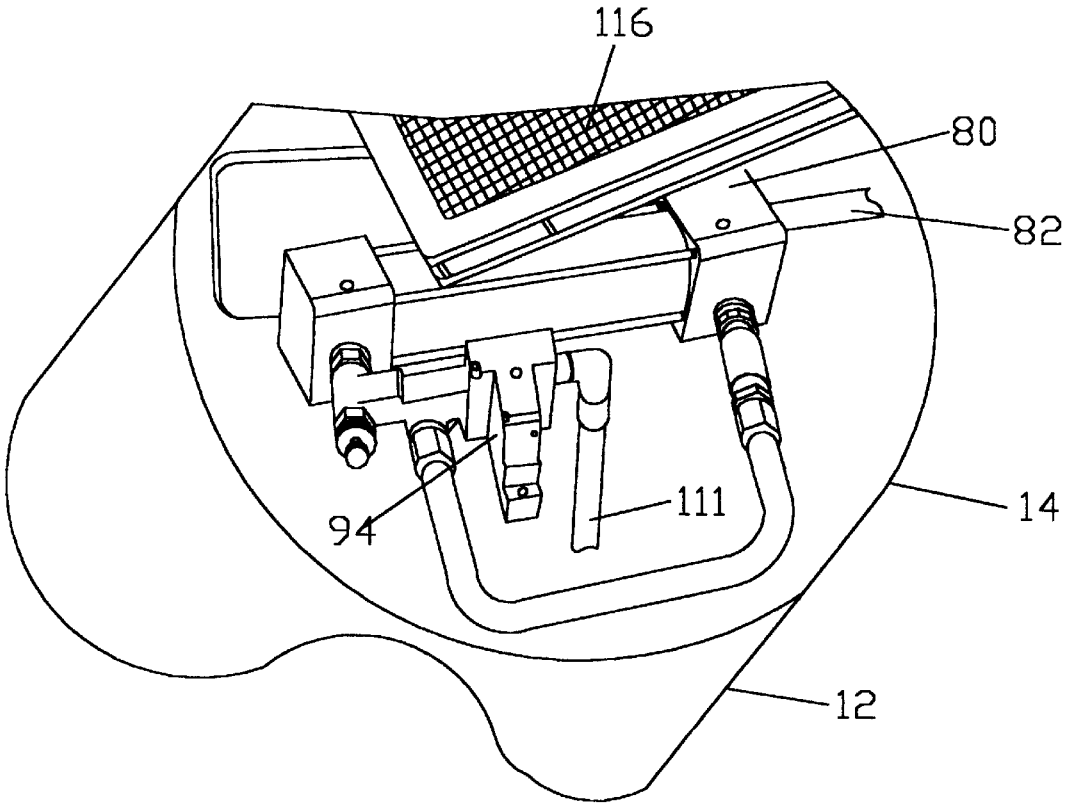
FIG. 8 is an oblique view of a portion of the ratchet mechanism which includes the solenoid attachments to the double acting cylinder actuator.

FIGS. 6–8 depict the ratchet mechanism by which the shaft 58 is rotated in this preferred embodiment. A double acting cylinder actuator 80 is mounted on a hinge 81 and is positioned such that a rod 82 is extendable across the housing top 14. Pivotally attached to the rod 82 is a rod connecting arm 84. The rod connecting arm 84 also connects to the shaft 58, although the shaft 58 rotates independently of the rod connecting arm 84. Attached to the shaft 58 is a sprocket 86. Rotatably attached to the rod connecting arm 84 is a ratchet pawl 88 which is urged against the sprocket 86 by the tension of the spring 90. A nut 92 is attached to the shaft 58 for rotation of the shaft 58 by a wrench, ratchet and socket, or other hand tools. Manual rotation allows each stick chamber 52 to be positioned beneath the housing top port nipple 18 for stick 66 insertion during the loading procedure. By manually lifting the ratchet pawl 88 from the sprocket 86, the shaft 58 can be rotated in a reverse direction, allowing for partial reloads where only some of the stick chambers 52 need reloading.

In this preferred embodiment, the rod 82 extends from, or retracts into, the double acting cylinder actuator 80 in response to pressure alterations within the double acting cylinder actuator 80. Well gas provides the pressure to operate the double acting cylinder actuator 80. The ends of the double acting cylinder actuator 80 are alternately pressurized and depressurized with a solenoid 94 regulating the changes. The alternating pressure causes the rod 82 to move from its normally extended position (FIG. 6) to its retracted position (FIG. 7). This movement causes the ratchet pawl 88 to engage and rotate the sprocket 86, which in turn rotates the magazine 50 which places a stick chamber 52 above the housing bottom port 22, causing the stick to be released into the well 36. In this preferred embodiment, the solenoid 94 then alternates the pressure after about 10 seconds, causing the rod 82 to return to its extended position. FIG. 8 depicts the double acting actuator cylinder 80, and the solenoid 94.

The housing top 14 has a pressure regulator port 100, by which pressurized well gas is passed through a pressure regulator port needle valve 101, then provided to and reduced by a first pressure regulator 102. The pressurized well gas is again reduced in a second pressure regulator 104. Pressure monitoring gauges 106,108 and a pressure relief valve 110 are also provided. In this preferred embodiment, the first pressure regulator 102 reduces the well gas pressure to within 50–150 psig, while the second pressure regulator 104 reduces the pressure to within 5–35 psig. The optimum operating pressure in this preferred embodiment is expected to be 30 psig. In this preferred embodiment the pressure regulator port needle valve 101 is a ¼ inch needle valve rated at 6000 psi, the first pressure regulator is a ¼ inch regulator (model 1301-F-2) rated at 6000 psi, the second pressure regulator 104 is a ¼ inch low pressure regulator rated at 255 psi. The pressure relief valve 110 is a ½ inch orifice, TEFLON seat relief valve set at 1440 psi. Persons skilled in the art will be familiar with other well known components by which the well gas pressure may be similarly regulated.

The well gas, having its pressure reduced, is routed through a stainless steel line 111 to a solenoid 94 which alternately pressures either end of the double acting cylinder actuator 80, causing the rod 82 to either extend or retract. When the rod 82 is extended, the ratchet pawl 88 engages the sprocket 86 such that when the rod 82 retracts, the sprocket 86 is rotated. Rotation of the sprocket 86 causes the magazine 50 to rotate, which in turn causes a stick chamber 52 to be positioned over the housing bottom port 68, allowing the stick 66 within such stick chamber 52, to be released through the housing bottom port 68.

In this preferred embodiment, the solenoid 94 alternates the pressure in response to a signal from a timer 114 and then automatically reverses after a predetermined amount of time, although it is contemplated within my invention that any variable process may be monitored and utilized to signal the solenoid 94, including other preferred embodiments where the solenoid 94 responds to an automatic telephone dialing code, remote signals, a low differential pressure, a low static pressure, or changes in flow rate.

In this preferred embodiment, the timer 114 is powered by a battery 116, the same being charged by a solar battery charger 118. This battery and charging mechanism can be used for various power requirements which may arise in other preferred embodiments, as well.

Other preferred embodiments of my invention include additional means for powering the timer 114, e.g. AC electrical supply or ordinary batteries.

In an alternative preferred embodiment (not shown) an emergency isolation valve is positioned between the bottom ball valve 28 and the well 36. The emergency valve is also positioned in fluid communication with the well gas, and closes upon sensing pressure in the well gas which is higher than a predetermined level.

In another alternative preferred embodiment (not shown) the magazine is rotated by rotation means such as an electric motor, instead of the ratchet mechanism discussed above. This would involve a coupling to the magazine shaft at the top or bottom.

In another alternative preferred embodiment (not shown) the pneumatic ratchet mechanism is powered by an independent source of air or gas (hydrocarbon gas or otherwise), other than the well gas.

In another alternative preferred embodiment each stick chamber 52 is sized to hold two or more sticks 66 in a substantially stacked, in-line position within the stick chamber 52.

Although the present invention has been described in considerable detail with reference to certain preferred and alternate embodiments thereof, other embodiments are possible. Accordingly, the spirit and scope of the claims should not be limited to the description of the embodiments contained herein.

I claim:

1. A process for periodically inserting one or more sticks of various materials into an oil or gas well, comprising the steps of:

providing an apparatus having a magazine with individual stick chambers, the apparatus being attached to a well;

rotating the magazine to provide access to only one such stick chamber at a time;

loading one or more sticks into one or more of such stick chambers as each stick chamber becomes accessible;

opening the magazine to fluid communication with the well;

rotating the magazine until one of the sticks is released into the well; and repeating the foregoing step, if desired, for one or more additional sticks, until a predetermined number of sticks have been released into the well.

2. An apparatus for periodically inserting one or more sticks of various materials into an oil or gas well, comprising:

stick positioning means comprising a magazine having a plurality of stick chambers for receiving and holding the sticks and positioning the sticks in a substantially vertical orientation;

stick loading means for loading sticks into the chambers, such stick loading means providing access to only one chamber at a time;

well entry means providing a path for the stick to exit the apparatus and enter the well; and periodic rotation means for moving each stick into position for insertion into the well.

3. An apparatus for periodically inserting one or more sticks of various materials into an oil or gas well, comprising:

a magazine, the magazine having a plurality of stick chambers, each stick chamber shaped to receive one of the sticks and orient the stick in a substantially vertical position;

a housing, the housing being shaped and sized to enclose the magazine, the magazine being rotatable within the housing, the housing having a top and a bottom, the housing top having a closable entry port, the housing top entry port being aligned with only one of the stick chambers, the housing top entry port being sized to allow one of the sticks to move through the housing top entry port into the stick chamber, the housing bottom having a exit port, the housing being attached to the well, such that the housing bottom exit port aligns with the well, the housing bottom exit port being of sufficient width to allow passage of the stick into the well;

a shaft, the shaft being attached to the magazine, the shaft being rotatable with the magazine; and periodic rotation means for rotating the shaft such that the stick chambers are sequentially positioned in stationary alignment with the housing bottom exit port.

4. The apparatus of claim 3, wherein the periodic rotation means is automatic.

5. The apparatus of claim 3, wherein the periodic rotation means is manual.

6. The apparatus of claim 3, wherein the periodic rotation means is powered by an electric motor.

7. The apparatus of claim 3, wherein the housing top is generally domed shaped.

8. The apparatus of claim 3, further comprising manual rotation means such that the shaft may be rotated manually.

9. The apparatus of claim 3, wherein the periodic rotation means is initiated in response to timer means.

10. The apparatus of claim 9, further comprising a battery for powering the timer means.

11. The apparatus of claim 10, further comprising a solar powered charger for charging the timer battery.

12. The apparatus of claim 3, wherein the periodic rotation means is initiated in response to low differential pressure.

13. The apparatus of claim 3, wherein the periodic rotation means is initiated in response to low static pressure.

14. The apparatus of claim 3, wherein the periodic rotation means is initiated in response to a predetermined decrease in well production rate.

15. The apparatus of claim 3, wherein the periodic rotation means is initiated in response to a remote signal.

16. The apparatus of claim 3, wherein the periodic rotation means is initiated in response to an automatic dialing code.

17. The apparatus of claim 3, wherein the periodic rotation means is initiated in response to a variable process.

18. The apparatus of claim 3, further comprising housing seal means for sealing the apparatus such that well gas is contained within the housing.

19. The apparatus of claim 3, further comprising well isolation means for isolating the housing top entry port from well gas pressure.

20. The apparatus of claim 3, wherein the well isolation means comprises a bottom valve between the housing bottom port and the well.

21. The apparatus of claim 3, further comprising pressure equalization means such that pressure communication can be alternately established and broken between the well and the housing.

22. The apparatus of claim 3, further comprising emergency isolation means for automatically isolating the housing from well gas pressure when the well gas pressure exceeds a predetermined level.

23. The apparatus of claim 3, further comprising housing pressure relief means for venting housing pressure when the housing pressure exceeds a predetermined level.

24. An apparatus for periodically inserting one or more sticks of various materials into an oil or gas well, comprising:

a magazine, the magazine having a plurality of stick chambers, each stick chamber shaped to receive one or more of the sticks and orient the sticks in a substantially vertical position;

a housing, the housing being shaped and sized to enclose the magazine, the magazine being rotatable within the housing, the housing having a top and a bottom, the housing top having a closable entry port, the housing top entry port being aligned with only one of the stick chambers, the housing top entry port being sized to allow one of the sticks to move through the housing top entry port into the stick chamber, the housing bottom having a exit port, the housing being attached to the well, such that the housing bottom exit port aligns with the well, the housing bottom exit port being of sufficient width to allow passage of one of the sticks into the well;

a shaft, the shaft being attached to the magazine, the shaft being rotatable with the magazine; and periodic rotation means for automatically rotating the shaft such that the stick chambers are sequentially positioned in stationary alignment with the housing bottom exit port.

25. An apparatus for periodically inserting sticks of various materials into an oil or gas well, comprising:

a magazine, the magazine having a plurality of stick chambers, each stick chamber shaped to receive one of the sticks and orient the stick or a substantially vertical position;

a housing, the housing being shaped and sized to enclose the magazine, the magazine being rotatable within the housing, the housing having a top and a bottom, the housing top having a closable entry port, the housing top entry port being shaped and sized such that the sticks may be loaded into the stick chambers, the housing bottom having an exit port, the housing being attached to the well, such that the housing bottom exit port aligns with the well, the housing bottom exit port being of sufficient width to allow passage of one of the sticks into the well;

a shaft, the shaft being attached to the magazine, the shaft being rotatable with the magazine; and pneumatic ratchet means for automatically rotating the shaft such that the stick chambers are sequentially positioned in stationary alignment with the housing bottom exit port.

26. The apparatus of claim 25, wherein the pneumatic ratchet means comprises:

a shaft rotation gear attached to the shaft;

an actuator having a frame and a rod, the rod being movable, with respect to the frame, from an extended position to a retracted position, the rod further having an exposed end;

a rod connecting arm, the rod connecting arm being pivotally attached to the shaft and the rod exposed end;

a ratchet pawl, the ratchet pawl being attached to the rod connecting arm and positioned to rotate the shaft rotation gear upon return of the rod from its extended position to its retracted position; and actuator pressure means, for activating the actuator such that the rod is caused to alternately move between its extended position and its retracted position.

27. The apparatus of claim 26, wherein the actuator pressure means receives pressured gas from the well to pressurize the actuator.

28. The apparatus of claim 26, wherein the actuator pressure means receives pressured gas from a source other than the well to pressurize the actuator.

29. The apparatus of claim 26, wherein the actuator pressure means further comprises well pressure reduction means for reducing the pressure of the well gas prior to pressurization of the actuator.

30. The apparatus of claim 26, further comprising released gas recovery means for containment of the well gas after release of such well gas from the actuator.

31. The apparatus of claim 25, wherein the housing top is generally dome-shaped.

32. The apparatus of claim 25, further comprising manual rotation means such that the shaft may be rotated manually.

33. The apparatus of claim 25, wherein the pneumatic ratchet means is initiated in response to timer means.

34. The apparatus of claim 33, further comprising a battery for powering the timer means.

35. The apparatus of claim 34, further comprising a solar powered charger for charging the timer battery.

36. The apparatus of claim 25, wherein the pneumatic ratchet means is initiated in response to low differential pressure.

37. The apparatus of claim 25, wherein the pneumatic ratchet means is initiated in response to low static pressure.

38. The apparatus of claim 25, wherein the pneumatic ratchet means is initiated in response to a predetermined decrease in well production rate.

39. The apparatus of claim 25, wherein the pneumatic ratchet means is initiated in response to a remote signal.

40. The apparatus of claim 25, wherein the pneumatic ratchet means is initiated in response to an automatic dialing code.

41. The apparatus of claim 25, wherein the pneumatic ratchet means is initiated in response to a variable process.

42. The apparatus of claim 25, further comprising housing seal means for sealing the apparatus such that well gas is contained within the housing.

43. The apparatus of claim 25, further comprising well isolation means for isolating the housing top entry port from well gas pressure.

44. The apparatus of claim 43, wherein the well isolation means comprises a bottom valve between the housing bottom port and the well.

45. The apparatus of claim 44, further comprising pressure equalization means such that pressure communication can be alternately established and broken between the well and the housing while the bottom valve is closed.

46. The apparatus of claim 25, further comprising emergency isolation means for automatically isolating the housing from well gas pressure when the well gas pressure exceeds a predetermined level.

47. The apparatus of claim 25, further comprising housing pressure relief means for venting housing pressure when the housing pressure exceeds a predetermined level.

48. An apparatus for periodically inserting sticks of various materials into an oil or gas well, comprising:

a magazine, the magazine having a plurality of stick chambers, each stick chamber shaped to receive one of the sticks and orient the stick or a substantially vertical position;

a housing, the housing being shaped and sized to enclose the magazine, the magazine being rotatable within the housing, the housing having a top and a bottom, the housing top having a closable entry port, the housing top entry port being shaped and sized such that the sticks may be loaded into the stick chambers, the housing bottom having an exit port, the housing being attached to the well, such that the housing bottom exit port aligns with the well, the housing bottom exit port being of sufficient width to allow passage of one of the sticks into the well;

a shaft, the shaft being attached to the magazine, the shaft being rotatable with the magazine; and pneumatic ratchet means for automatically rotating the shaft such that the stick chambers are sequentially positioned in stationary alignment with the housing bottom exit port.

* * * * *